US009909758B2

(12) United States Patent
Biagioli et al.

(10) Patent No.: US 9,909,758 B2
(45) Date of Patent: Mar. 6, 2018

(54) GAS BURNER WITH IMPROVED PRIMARY AIR DUCT

(75) Inventors: Nico Biagioli, Sansepolcro (IT); Piero Armanni, Forli (IT); Marco Starnini, Forli (IT)

(73) Assignee: Electrolux Home Products Corporation N.V., Brussels (BE)

( * ) Notice: Subject to any disclaimer, the term of this patent is extended or adjusted under 35 U.S.C. 154(b) by 1404 days.

(21) Appl. No.: 12/745,785

(22) PCT Filed: Dec. 4, 2008

(86) PCT No.: PCT/EP2008/066833
§ 371 (c)(1),
(2), (4) Date: Oct. 27, 2010

(87) PCT Pub. No.: WO2009/077348
PCT Pub. Date: Jun. 25, 2009

(65) Prior Publication Data

US 2011/0048400 A1 Mar. 3, 2011

(30) Foreign Application Priority Data

Dec. 18, 2007 (EP) ..... 07123470

(51) Int. Cl.
*F24C 3/00* (2006.01)
*F23D 14/06* (2006.01)
(Continued)

(52) U.S. Cl.
CPC ..... *F23D 14/06* (2013.01); *F23D 14/64* (2013.01); *F23D 2900/14062* (2013.01); *F23D 2900/14701* (2013.01)

(58) Field of Classification Search
USPC ..... 126/39 E, 39 BA, 27, 99 C; 431/278, 431/283, 284
See application file for complete search history.

(56) References Cited

U.S. PATENT DOCUMENTS 1,947,866 A * 2/1934 McCourt ..... 431/284
2,335,188 A * 11/1943 Kennedy ..... 431/284
(Continued)

FOREIGN PATENT DOCUMENTS

DE 3930569 A1 * 3/1991 ..... F23D 11/36
EP 2053309 A1 * 4/2009 ..... F23D 14/06
(Continued)

OTHER PUBLICATIONS

Schilling, Siegfried W, Patent Document DE 39 30 569 A1 Machine Translation of Description, Oct. 26, 2016, Patent Translate, p. 1-9.*
(Continued)

*Primary Examiner* — Steven B McAllister
*Assistant Examiner* — Desmond C Peyton
(74) *Attorney, Agent, or Firm* — Pearne & Gordon LLP

(57) ABSTRACT

Gas burner, particularly for household cooking appliances, with an horizontal or vertical gas supply conduit (1), a burner body with one more flame crowns, an horizontal or vertical Venturi (4), a nozzle (5) to inject the gas flow from said gas conduit into said Venturi pipe and, means to provide the primary air flow which include a tubular conduit which is coaxial and placed outside said gas conduit, and an opening to allow the gas flow, placed between said nozzle and the inlet of the Venturi pipe. The coaxial conduit draws the respective air flow from a zone inside the body of said cooking appliance, and said opening allows the passage of the respective primary air flow sucked and coming from over the appliance top surface (12). In order to stir the primary air flow passing through said coaxial conduit, a plurality of radial wings (10A) is arranged, said wings being shaped either planar or helical, and being connected on the outer surface of said gas supply conduit.

13 Claims, 9 Drawing Sheets

Figure 1:
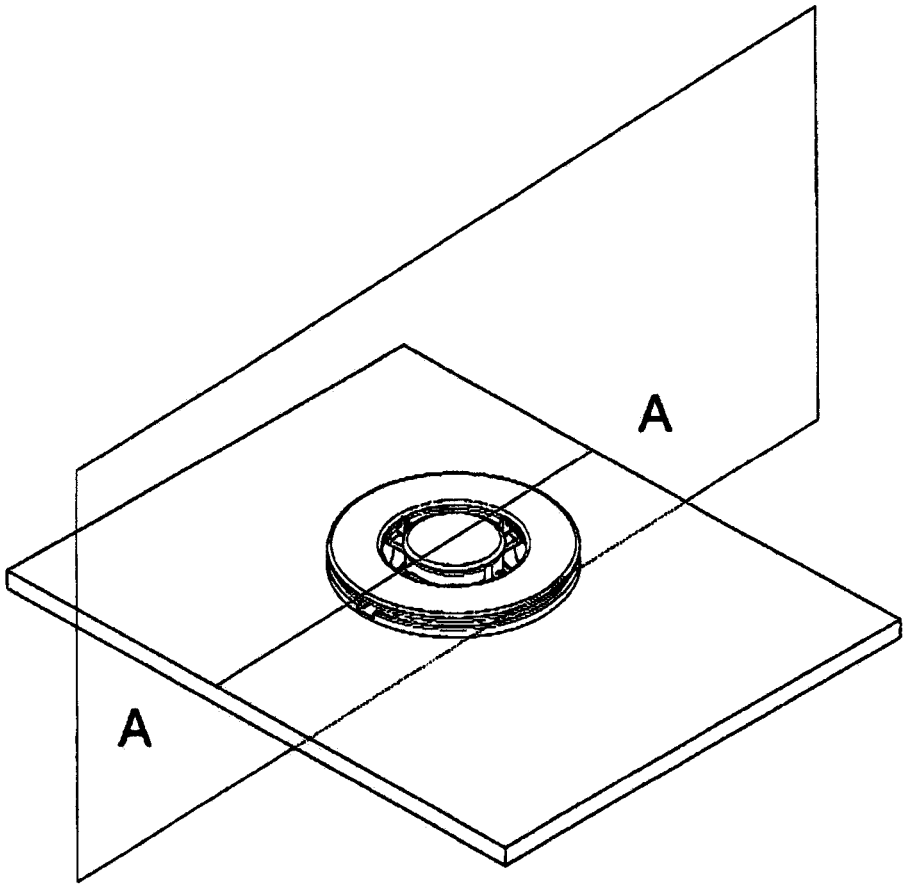
Figure 1A:
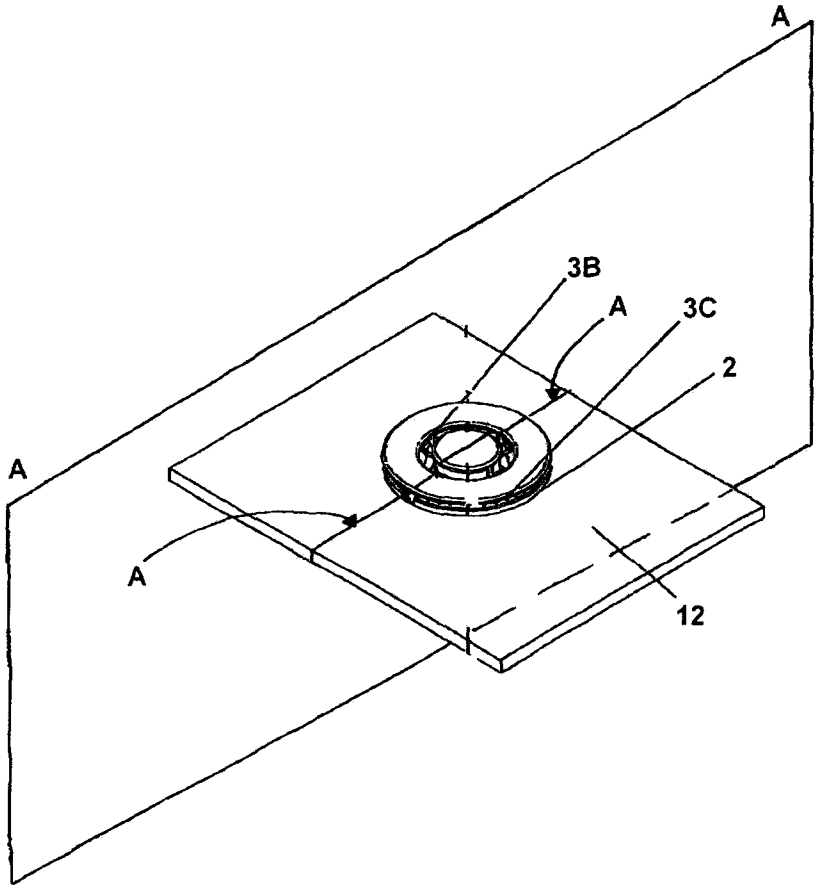

(51) Int. Cl.
*F23D 14/64* (2006.01)
*F24H 3/06* (2006.01)

(56) References Cited

U.S. PATENT DOCUMENTS

| | | | | |
|---|---|---|---|---|
| 3,486,834 | A * | 12/1969 | Roerden | F23D 14/00 431/12 |
| 3,792,582 | A * | 2/1974 | Markowski | F23R 3/34 431/284 |
| 5,567,148 | A | 10/1996 | Krueger et al. | |
| 6,116,171 | A * | 9/2000 | Oota et al. | 110/263 |
| 6,325,619 | B2 * | 12/2001 | Dane | F23D 14/065 126/39 E |
| 6,951,454 | B2 | 10/2005 | Sarv et al. | |
| 8,221,116 | B2 * | 7/2012 | Biagioli et al. | 431/284 |
| 8,753,112 | B2 * | 6/2014 | Armanni | F23D 14/065 126/39 E |
| 2001/0010897 | A1 * | 8/2001 | Dane | 431/266 |
| 2001/0041316 | A1 * | 11/2001 | Haynes et al. | 431/278 |
| 2002/0192615 | A1 * | 12/2002 | Moriya et al. | 431/278 |
| 2005/0037305 | A1 * | 2/2005 | Moriya et al. | 431/284 |
| 2005/0279862 | A1 | 12/2005 | Mao et al. | |
| 2006/0199119 | A1 | 9/2006 | Abbasi et al. | |
| 2008/0202494 | A1 * | 8/2008 | Paesani | F23D 14/065 126/39 E |

FOREIGN PATENT DOCUMENTS

| | | | | |
|---|---|---|---|---|
| EP | 2236921 | A1 * | 10/2010 | F23D 14/06 |
| FR | 1043707 | | 11/1953 | |
| FR | 1043707 | A * | 11/1953 | F23D 14/06 |
| FR | 1055564 | | 2/1954 | |
| JP | 3244905 | | 10/1991 | |
| JP | 3244906 | | 10/1991 | |
| WO | WO 9908046 | A1 * | 2/1999 | F23D 14/06 |
| WO | 2007068659 | | 6/2007 | |

OTHER PUBLICATIONS

Schilling, Siegfried W, Patent Document DE 39 30 569 A1 Machine Translation of Claims, Oct. 26, 2016, Patent Translate, p. 1-4.*
International Search Report for PCT/EP2008/066833, dated Feb. 24, 2009, 3 pages.

* cited by examiner

GAS BURNER WITH IMPROVED PRIMARY AIR DUCT

The present invention relates to a gas burner, preferably of the type generally used in the household cooking gas appliances and in particular gas built-in hobs, provided with improved means to convey the primary air into the Venturi pipe.

In the following of this description it will be referred to a gas burner provided with both a central body with a peripheral flame crown, and a perimetral body provided with two flame crowns, oriented inwards and outwards, but it will be intended that what explained may be identically applied and therefore valid also for gas burners provided with only a peripheral body, that is without the central flame body.

It is known that in such kind of cooking gas appliance two main requirements are present:

- a constructional and assembly requirement, i.e. the cooking gas appliance, particularly when it is a gas hob, has to show a minimum height, due to constraints which are well known to the man skilled in the art, and therefore will not be repeated, and
- a functional requirement, consisting in that the burner, specially those burners with limited diameter, are requested to provide in any case a suitable thermal power, and in any case the maximum possible power.

These two requirements are however in apparent contradiction to each other, as the need to keep down the total gas appliance height obliges to also keep down the same height of the Venturi pipes providing the gas to the burners; however such limitation operates also as a limitation for the amount of gas/air mixture which can be produced, and therefore determines the limit of the burner thermal power.

In order to overcome such reciprocal conditioning, some cooking appliances have been proposed and divulged, which are provided with one ore more Venturi pipes which are horizontally extended as for instance in the patents WO 2005/078342 and WO 2007/012766.

It is apparent that by horizontally placing the Venturi pipes, it is automatically void the problem of their height which conditions the overall height of the cooking appliance.

Moreover the two cited patents show respective solutions wherein the Venturi pipes leave from the burner central zone and branch out radially; therefore their total length is limited by the radius, that is by the horizontal size of the burner itself.

In order to eliminate such condition it was proposed, for instance in EP Publication 1120603 and in EP Application n. 07119078.9 a type of burner wherein the Venturi pipe is placed into horizontal for the whole width, that is basically for the diameter of the burner body itself.

However the showed solutions suffer from a quite common drawback in such type of burners, that is from the fact that the primary air is sucked and sent to the inlet of the Venturi pipe from one access way only, i.e. either from the inner box body of the cooking appliance, or from the outer room, that is from the zone over the cooking hob itself.

Of course such circumstance does limit the total amount of the available primary air, and therefore limits the available thermal power.

In order to increase the primary air inlet flow, it was proposed to intake and convey the primary air flow through a coaxial and preferably tubular conduit, the final portion of which ending with the gas injection nozzle.

Such solution is for instance divulged in the patents:

a) US 2006/0199119, b) U.S. Pat. No. 6,951,454, c) JP 3-244906, d) JP 3-244905, e) US 2005/0279862.

However no one of said patents suggest, and even less divulgates, the solution which shows that the primary air flow, bound to the Venturi pipe, is taken from two distinct access ways, that is from a conduit which is coaxial to the gas conduit, and also from an opening which is independent of said coaxial conduit.

It would therefore be desirable, and is actually a main purpose of the present invention, to implement a kind of burner provided with two different and distinct inlet ways for the primary air flows to the Venturi pipe made up by a conduit which is coaxial to the gas conduit, and by an opening or gate placed just after the gas injection nozzle, wherein said access ways are independently flown with air taken from the inside of the box body of the cooking appliance, and from the outer room over it.

However such purpose turns to be profitable not only with gas conduits and related Venturi pipes when horizontally oriented, where the benefits are more apparent, but also with cooking appliances provided with gas conduits and Venturi pipes which are vertically oriented, even if some drawbacks may be experienced caused by the height of the cooking appliance, yet the same the same benefits due to a double primary air suction are achieved, i.e. from the inside of the cooking appliance body, and from the outer room over it.

Figure 2:
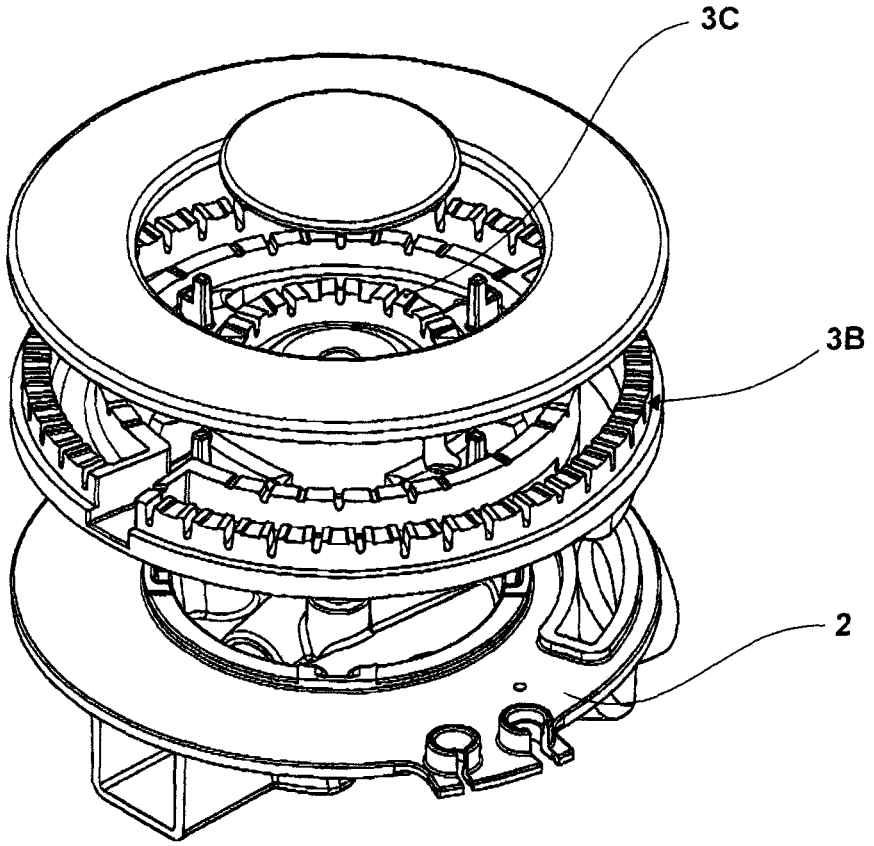
Figure 3:
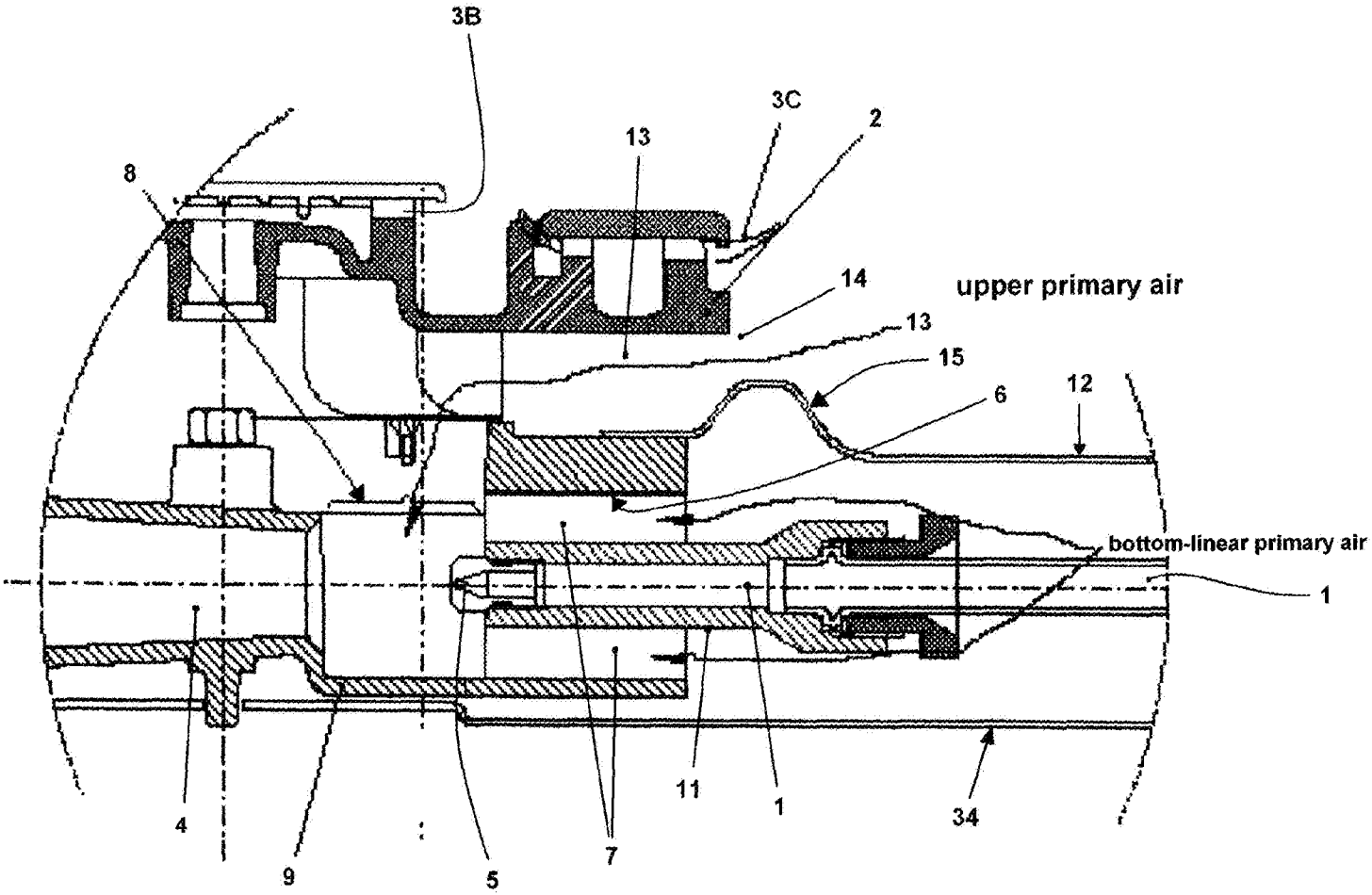
Figure 3A:
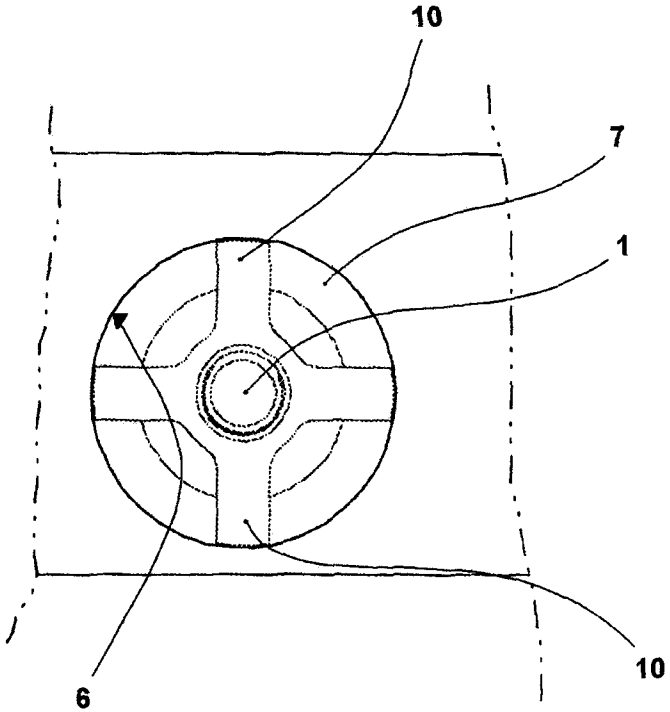
Figure 4A:
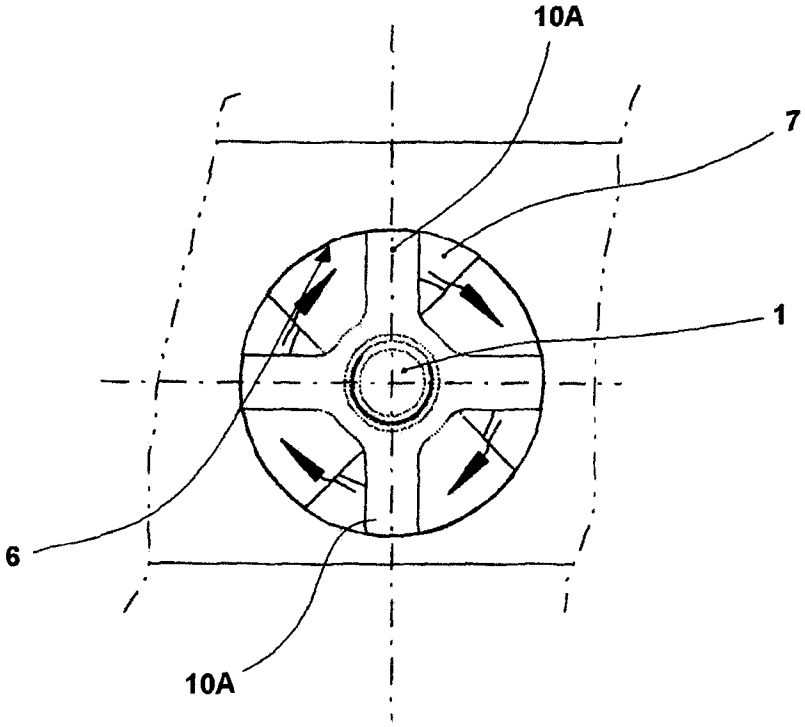
Figure 4:
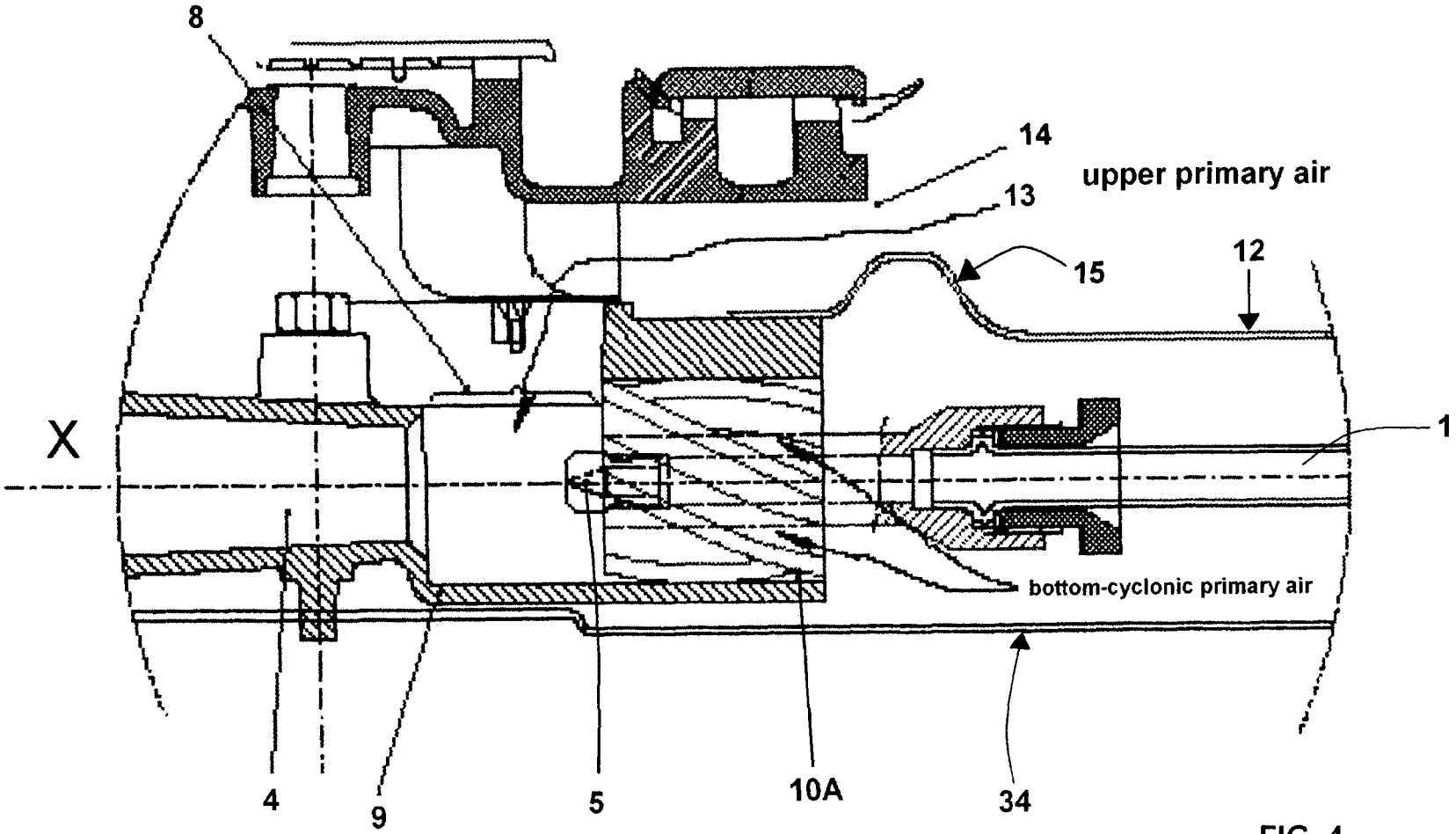
Figure 5:
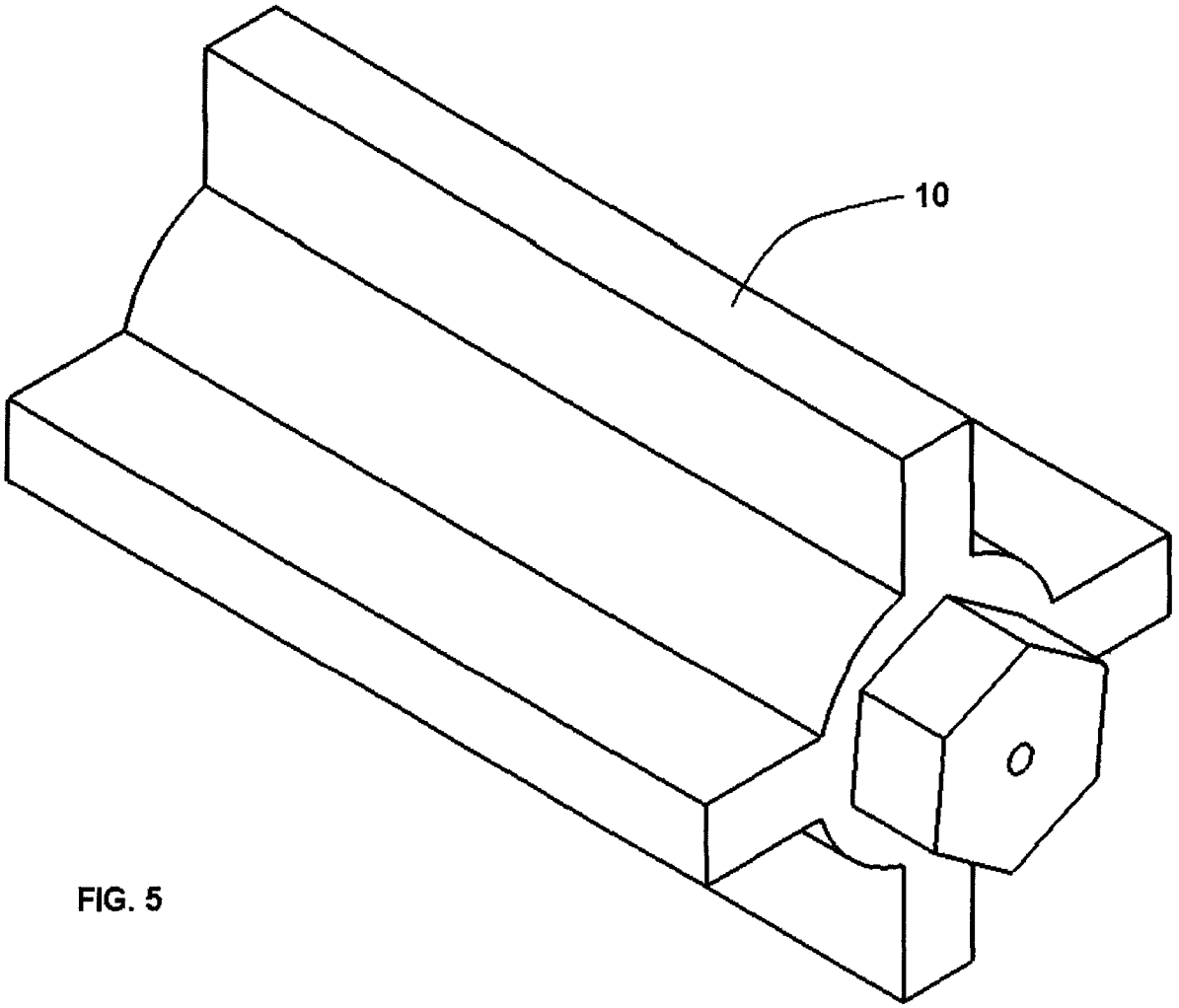
Figure 6:
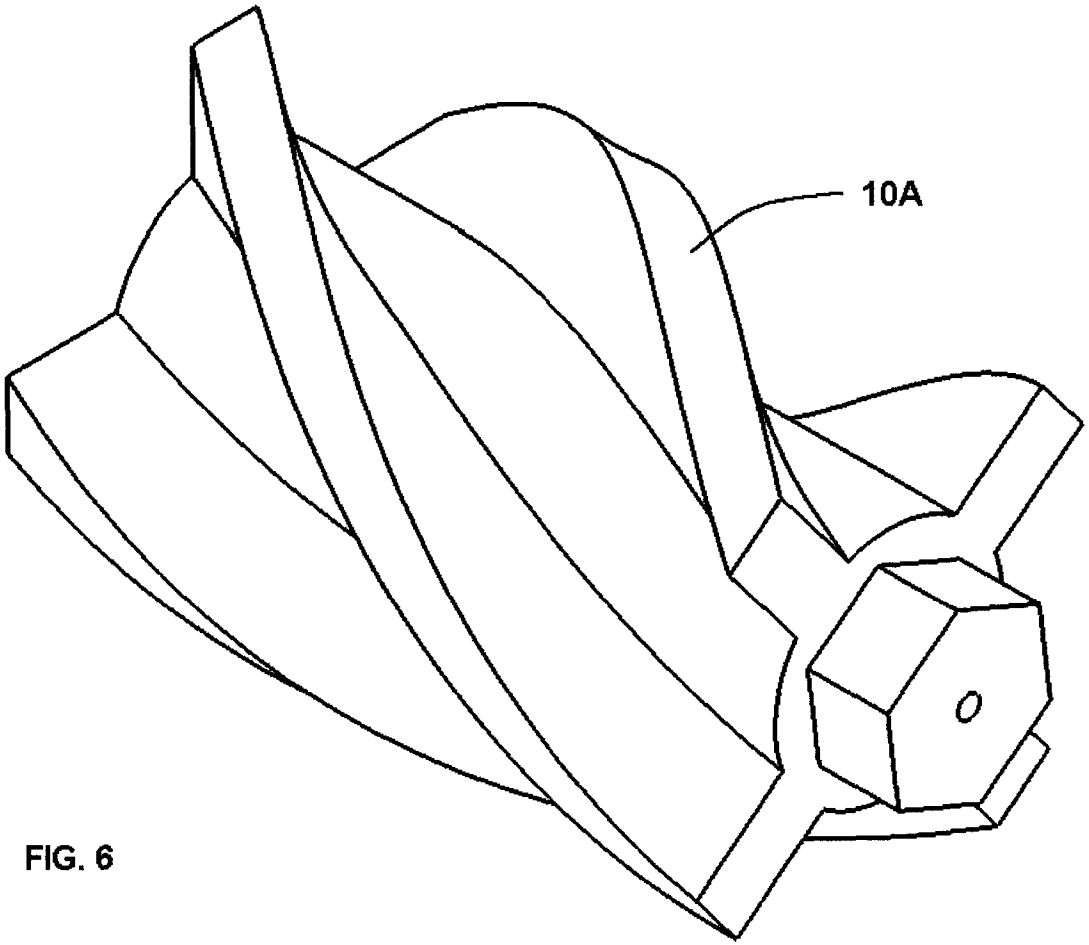
Figure 7:
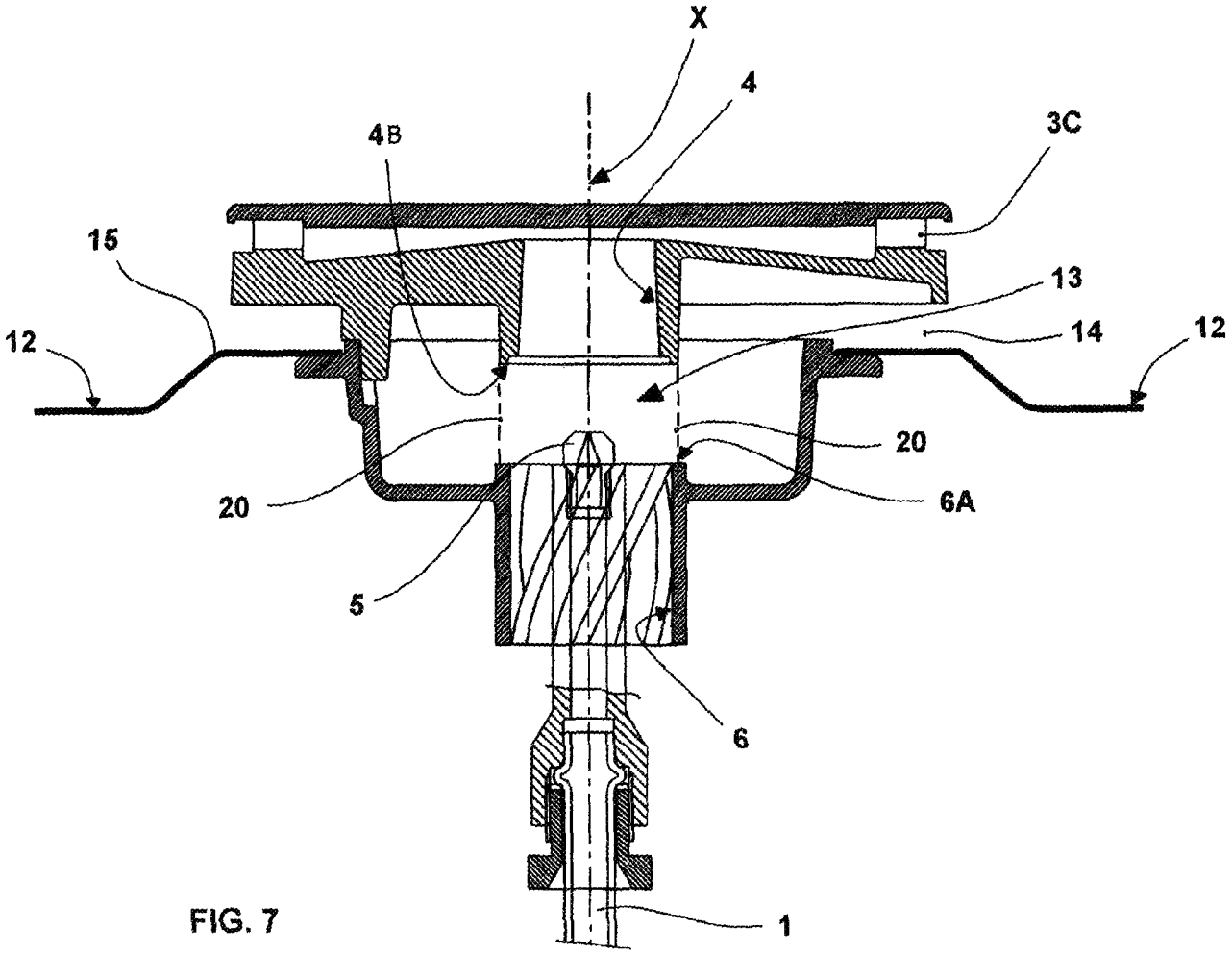

According to the present invention, this and further aims are reached in a kind of burner provided with a Venturi pipe which can be either horizontally or vertically extended, which is provided with connecting and inlet conduits for the primary air flow incorporating the characteristics as recited in the appended claims and including such operating means as described below by mere way of non-limiting example with reference to the accompanying drawings, in which:

FIG. 1 is a perspective outer view of a burner body and of the relevant cooking gas appliance, here represented by a gas hob, according to a first embodiment of the invention, FIG. 2 is an exploded view of the cooking burner shown in FIG. 1, FIG. 3 shows a vertical and side section view according to the section A-A of the assembly of FIG. 1, FIG. 3A shows a section view, which is orthogonal to the "X" axis of the gas conduit, of a detail of the burner assembly of FIG. 3, FIG. 4 shows a vertical and side section view according to the section A-A of a different embodiment of the assembly of FIG. 1, FIG. 4A shows a section view, which is orthogonal to the "X" axis of the gas conduit, of a detail of the burner assembly of FIG. 4, FIGS. 5 and 6 do show perspective views of the details respectively shown in FIGS. 3A and 4A, FIG. 7 shows a view which is equivalent to FIG. 3, but referred to a cooking appliance provided with a gas conduit and a Venturi pipe which are vertically oriented.

With reference to FIGS. 1 to 4, a cooking appliance according to the invention comprises:

- a gas supply conduit 1 horizontally oriented,
- a burner body 2 on which one or more flame crowns 3B, 3C . . . are mounted,
- a Venturi pipe 4 which is also extended into horizontal, and is substantially aligned with the final portion of said conduit 1,
- an gas injection nozzle 5 at the end of said conduit 1 towards said Venturi pipe 4.

The primary air is being conveyed towards said nozzle 5 and into said Venturi pipe through two different flowing paths, i.e.:

the first path consists of a suction air flow beginning from inside the body of the cooking appliance, and which in its end portion takes the form of a conduit 6 coaxial with said first gas conduit 1, having a preferably tubular shape, and which surrounds it at least in the end portion; therefore between said gas conduit 1 and said coaxial conduit 6 a prolonged annular interspace 7 is formed, in which flows a share of the primary air, sucked by the Venturi pipe.

As clearly shown in the figures, said coaxial conduit 6 stretches towards said Venturi pipe 4, to which it joins through a suitable prolongation 9; as a matter of facts, it may be observed that the Venturi pipe is merely the properly shaped continuation of said prolongation 9, which to its time stretches ahead beyond said injector 5;

the second path consists of a channel 13 whose suction mouth opens over of the upper plane 12, and in its end portion a through opening 8 is arranged, preferably placed on a side of said prolongation 9, just downstream of said injector 5 and upstream of said Venturi pipe 4.

Said through opening 8 then allows the primary air flow to pass from the outer room towards said Venturi pipe 4, so achieving the first invention goal, i.e. to make the primary air to intake by splitting the whole flow into two separate flows, one of which being arranged over said upper plane 12, and the other being conveyed from the inside of the cooking appliance and which in its end path enters into a conduit which is coaxial to the gas conduit.

The just described solution allows some profitable improvements; the first improvement consists in that, as shown in FIGS. 3 and 4, said coaxial conduit 6 draws the relevant primary air flow directly from the inner volume delimited by the box body 34 of the cooking appliance, while instead said opening 8 is connected to the outer room, and exactly from over its top surface.

This circumstance favors a better air flowing in the case that the cooking appliance is undesirably lodged in such a way that the air circulation is obstructed or slowed down; moreover the two primary air flows, so conveyed, do not interfere in any working condition.

Also it is preferred that said opening 8 is placed upwards in said prolongation 9, so as to shorten and to make straighter the path of that share of primary air flow coming from over the cooking appliance.

Such solution is suitable to match the temperature increase; since the heating from the burner reduces the density of the primary air, it is important to improve the primary air flow, in order to avoid compromising the burner functionality (combustion performances, yellow tipping and soot).

In order to improve the mixing of the gas with the primary air, it was experienced as an useful improvement to arrange some means able of causing a turbulence in gas flow when coming out from the conduit 1, so that the gas flow itself is being broken and therefore it is easier mixed with the primary air flow.

It was then found profitable to arrange some suitable means able of creating a turbulence in the air passing through said interspace 7, so that the air going out from it, and basically from said coaxial conduit 6, is soon mixed both to the gas exiting from the conduit 1, and to the primary air flow entering from said opening 8.

Such complete and prompt mixing effect both with the gas and with the primary air flow obviously causes the mixture itself to become optimized, what improves the combustion performances.

To this purpose, inside said interspace 7 and on the outer surface 11 of said gas conduit some stirring wings 10 are arranged; according to the turbulence effect which is wanted, and also to the diameter of the coaxial conduit 6 itself, the two following embodiments are proposed:

in the first embodiment and with ref to the FIGS. 3 and 3A, said wings 10 are flat, are preferably passing on the "X" axis of said gas conduit 1, are radially oriented on the outer surface of the gas conduit 1, are regularly distributed at the same angular distance to each other, and preferably are quite prolonged so as to be extended for the whole length of said coaxial conduit 6.

in the second embodiment and with ref. to FIGS. 4 and 4A, said wings 10A are bent and specifically are placed in an helical arrangement, as a screw thread, whose inner edge is still attached on the outer surface of the gas conduit 1; said wings 10A too are regularly distributed with the same angular distance, and preferably are quite prolonged so as to be extended for the whole length of said coaxial conduit 6.

The two just described improved embodiments are obviously helpful to make up a cooking appliance which is particularly effective not only from the point of view of the thermal power supply, but also which is compact and especially cheap and simple in the construction; moreover the invention may be highly appreciated also due to the advantage that the nozzle replacement may be carried out without any need to open the appliance, as this operation may be performed across said opening 8.

As just described, the shown embodiments may be implemented by a gas conduit and a Venturi pipe which are horizontally oriented, as represented in the FIGS. 2, 3 and 4; however, as previously remembered, it is also possible to make up the invention by placing the gas conduit and the relevant Venturi pipe vertically oriented, as schematically shown in FIG. 7.

In said case it has been proved that the most suitable embodiment, both from a functional and a constructive point of view is offered by the FIG. 7 itself, wherein said Venturi pipe is substantially separated from the coaxial conduit 6 (differently from FIG. 3, wherein said devices are interconnected by said prolongation 9).

Therefore the outlet mouth of the conduit 6 is completely opened, and so the air path, coming from the outside and sucked into the channel 13, crosses an opening 20 showing a substantially cylindrical or frustum-conical shape, extended on the horizontal plane for 360°, and connecting the outlet mouth 6A of the coaxial conduit to the inlet mouth 4B of the Venturi pipe 4.

Furthermore, and preferably, said same upper plane 12 makes also the lower side of the channel 13 through which the primary air is sucked into said second path and is conveyed into said opening 8.

So the inlet 14 of said channel 13 is then opened just over said upper plane 12; moreover, in correspondence of said mouth 14 said surface 12 takes a profile in relief 15, so as the incidental liquids and cooking remnants are prevented from entering said channel 13; advantageously said relief profile 15 may easily be obtained by a proper pressing/bending operation of this same upper plane 12.

The invention claimed is:

1. A cooking appliance including a gas burner, comprising:

a burner body on which one or more flame crowns are mounted;

a Venturi pipe, comprising a prolongation;

a gas supply conduit configured to supply gas to the gas burner, wherein said gas supply conduit comprises a nozzle arranged inside said burner body, wherein said nozzle is configured to inject gas from said gas supply conduit into said prolongation of said Venturi pipe;

a first flow path and a second flow path, wherein the first flow path is configured to draw inner air from an inner zone of said cooking appliance, and wherein the second flow path is configured to draw upper air from an upper zone of said cooking appliance, wherein said inner zone is arranged below a surface of said cooking appliance and wherein said upper zone is arranged above said surface of said cooking appliance, wherein said surface separates said upper air from said inner air, such that said upper air and said inner air remain separate until converging and mixing with gas in the prolongation of the Venturi pipe, wherein the first flow path comprises an annular interspace comprising a coaxial conduit arranged around and coaxial to said gas supply conduit, and wherein the second flow path comprises a channel comprising a through opening arranged at said prolongation of said Venturi pipe, and air turbulating means arranged inside said annular interspace and extending from an outer surface of said gas supply conduit to an inner surface of said coaxial conduit, wherein said air turbulating means are configured to stir the inner air within said coaxial conduit.

2. The cooking appliance according to claim 1, wherein said air turbulating means comprise a plurality of wings, radially arranged with respect to a longitudinal axis of said gas supply conduit.

3. The cooking appliance according to claim 1, wherein said air turbulating means comprise a plurality of wings, helicoidally arranged with respect to a longitudinal axis of said gas supply conduit.

4. The cooking appliance according to claim 1, wherein said coaxial conduit and said Venturi pipe are horizontally oriented, and wherein said prolongation is arranged between and connects said coaxial conduit to an inlet of said Venturi pipe, and wherein said through opening is arranged in an upper portion of said prolongation.

5. The cooking appliance according to claim 1, wherein said gas supply conduit, said Venturi pipe, and said coaxial conduit are vertically oriented and substantially coaxially aligned with respect to a vertical axis, and wherein said through opening comprises a cylindrical or frustum-conical opening substantially aligned with respect to the vertical axis, and wherein said through opening is arranged between and connects an inlet of said Venturi pipe to said coaxial conduit.

6. The cooking appliance according to claim 1, wherein said surface of said cooking appliance comprises an inflow channel comprising an inlet mouth.

7. The cooking appliance according to claim 1, wherein the Venturi pipe is horizontally oriented.

8. The cooking appliance according to claim 1, wherein an opening is provided between an outlet of the coaxial conduit and an inlet of the Venturi pipe.

9. The cooking appliance according to claim 5, wherein said surface of said cooking appliance separates said upper air from said inner air, such that said upper air and said inner air remain separate until converging and mixing with gas at the through opening.

10. The cooking appliance according to claim 6, wherein said surface of said cooking appliance comprises a relief shape arranged near said inlet mouth and configured to substantially prevent spills from entering said inflow channel.

11. The cooking appliance according to claim 9, wherein the through opening extends substantially 360° around the vertical axis.

12. The cooking appliance according to claim 9, wherein said surface of said cooking appliance comprises an inflow channel comprising an inlet mouth.

13. The cooking appliance according to claim 12, wherein said surface of said cooking appliance comprises a relief shape arranged near said inlet mouth and configured to substantially prevent spills from entering said inflow channel.

* * * * *